United States Patent [19]

Begnaud

[11] 4,378,896

[45] Apr. 5, 1983

[54] REMOVABLE HATCH LID

[75] Inventor: Claude M. Begnaud, Houma, La.

[73] Assignee: Texaco Inc., White Plains, N.Y.

[21] Appl. No.: 275,098

[22] Filed: Jun. 19, 1981

[51] Int. Cl.[3] ..... B65D 45/00

[52] U.S. Cl. ..... 220/327; 141/59

[58] Field of Search ..... 220/327, 85 VR, 85 VS; 141/59, 65, 66, 7

[56] References Cited

U.S. PATENT DOCUMENTS 3,556,127 1/1971 MacKinnon ..... 141/59 X

*Primary Examiner*—George T. Hall

*Attorney, Agent, or Firm*—Carl G. Ries; Robert A. Kulason; Henry C. Dearborn

[57] ABSTRACT

A special purpose removable hatch lid. It incorporates a connector for attaching suction means to it. And, it is adapted for being fastened down over the coaming of a thief hatch which is located on a large tank. The lid is applied prior to entry into the large tank for the purpose of cleaning the interior of the tank. Use of the lid greatly facilitates a degasing of the tank interior.

6 Claims, 2 Drawing Figures

REMOVABLE HATCH LID

BACKGROUND OF THE INVENTION

1. Field of the Invention

This invention concerns a special purpose hatch lid, or cover, that is adapted for use in gas freeing large tanks. It is especially applicable to tanks which contain fumes such as from hydrocarbons or the like.

In connection with large stock tanks, the periodic cleaning of the interior thereof involves entry within a tank by personnel. Consequently, there is the necessity of removing any fumes left over from the product which the tank contained.

2. Description of the Prior Art

It has been the practice heretofore to open any so-called thief hatches that are located in or near the top of a large tank, followed by the opening of a clean-out hatch located near the bottom of the tank. Then, personnel would enter through the clean-out hatch to proceed with a cleaning procedure. When that procedure was used for cleaning such tanks, it was necessary to allow a substantial amount of time to pass, e.g. on the order of many hours, for the fumes within the tank to exit through the thief hatch or hatches. However, by making use of a special hatch lid in accordance with this invention, the removal of fumes may be carried out in short order by connecting an eductor or other suction arrangement onto the latch lid while maintaining a tight seal for the fumes. Then, fumes are drawn out from the large tank.

SUMMARY OF THE INVENTION

Briefly, the invention concerns a removable hatch lid for attaching suction means to degas fumes from a large tank. The tank has at least one hatch with a coaming integral therewith. The invention comprises impervious planar means for contacting said coaming to close said hatch. It also comprises means for fastening said planar means in sealing relation with said coaming, and gas tight means for coupling said suction means to said planar means for degasing said large tank.

Again briefly, the invention concerns a removable hatch lid for attaching suction means to degas fumes from the interior of a large tank prior to cleaning said interior. The large tank has at least one hatch with a coaming integral therewith. And, it has a first plurality of bolts therearound. The invention comprises in combination, a flat metallic plate extending radially beyond the walls of said coaming. And, it comprises a resilient material gasket layer bonded to said metallic plate for making a gas tight seal with said coaming. It also comprises a nipple centrally located and integrally attached to said flat plate for location over the inside of said coaming and adapted for attaching said suction means thereto. And, it comprises a second plurality of bolts aligned with said first plurality of bolts, and a corresponding plurality of socket means all for fastening said plate and gasket layer onto said coaming with a gas tight connection.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

Figure 1:
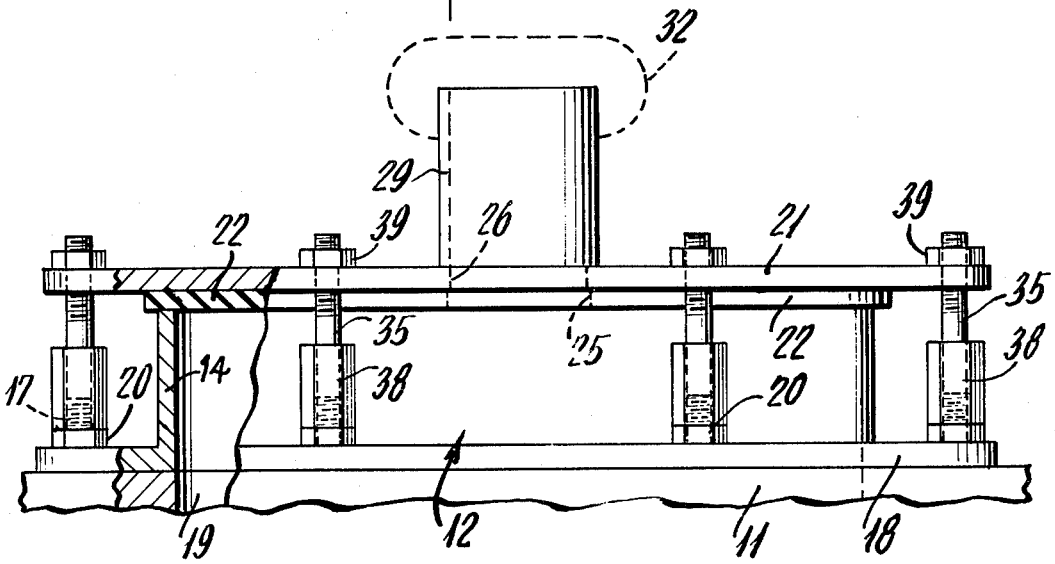
FIG. 1 is a side elevation partly broken away in cross section and illustrating a hatch lid structure according to the invention, as applied to a thief hatch of a large tank.

In large stock tanks there is a periodic need for cleaning the interiors. In the past, the procedure for carrying out such interior cleaning involved a long time consuming operation because of the need to degas the interior prior to the cleaning. Thus, a large stock tank of the type to which this invention is applicable has a clean-out hatch somewhere at or near the bottom of the tank, which hatch is large enough to permit personnel to enter the tank. Also, the tank is constructed with one or more so-called thief hatches usually located at or near the top of the tank. Such thief hatches are relatively small and provide for inspection or other limited access to the interior of the tank.

The procedure which was carried out heretofore involved the opening of the thief hatch or hatches, plus the opening of the clean-out hatch, and then allowing the tank to stand for a long period of time in order to permit circulation of air through the tank to remove the fumes by natural circulation. That would pollute the nearby atmosphere in addition to being very time consuming. However, it was discovered that by making use of a removable hatch lid according to this invention for application to one or more of the thief hatches, suction equipment could be connected so as to draw out the fumes and, thus, degas the interior of the tank in a very short period of time. In addition, there would be no pollution of the atmosphere.

With reference to the drawings, it will be observed that there is a fragmentary portion of a large tank 11 illustrated. A thief hatch 12 is mounted on the tank 11. It is constructed with a coaming 14 that stands up from a surface 15 of the tank 11. The coaming 14 has a flange 18 by means of which it is bolted onto the surface 15 of the tank 11, e.g. by means of a first plurality of bolts 17 and nuts 20. This then leaves an opening 19 in the tank 11 underneath the inside of the coaming 14 into the interior of the tank 11.

It will be appreciated that the thief hatch opening may be circular or oblong in shape. Also, as indicated above, there may be a number of these for a given tank. Each thief hatch is provided with a hinged lid (not shown) that may be closed under ordinary conditions, i.e. when the tank is filled with product. However, when a degasing operation is to be carried out, e.g. prior to cleaning the interior of the tank 11, the lid (not shown) will be swung back on its hinge (not shown) leaving the top edge of the coaming 14 unobstructed.

A removable hatch lid according to this invention is made up of a flat metallic plate 21 that extends radially from the center of the thief hatch opening within the coaming 14 for a short distance beyond the walls of the coaming 14. There is also a resiliant material gasket layer 22 that is securely bonded to the underside of the plate 21. The gasket 22 has a central hole or opening 25 which is in alignment with a similar hole 26 through the plate 21. The hole 26 is for accommodating an integrally attached nipple 29 that may be welded, or otherwise integrally attached to the plate 21.

The purpose of the nipple 29 is for attaching a suction means, e.g. an educator 32 (schematically indicated by dashed lines in FIG. 1) to the free end of the nipple 29. Such attachment may, of course, be in any feasible manner, for example the upper end of the nipple 29 may have exterior threads (not shown) thereon.

There is a second series of bolts 35 that are attached through the edge of the plate 21 where it extends out beyond the coaming 13. These bolts 35 are arranged to be in alignment with the bolts 17 around the base of the coaming 14. Also, there are a plurality of sockets 38 which may take various forms such as octagonal pieces with interior threaded holes to accommodate the upper ends of the bolts 17 above the nuts 20. It will be understood that there are nuts 39 which cooperate with the threaded ends of the bolts 35 to provide the fastening for the plate 21 and its gasket layer 22 so as to hold them firmly down onto the top edge of the coaming 14.

Figure 2:
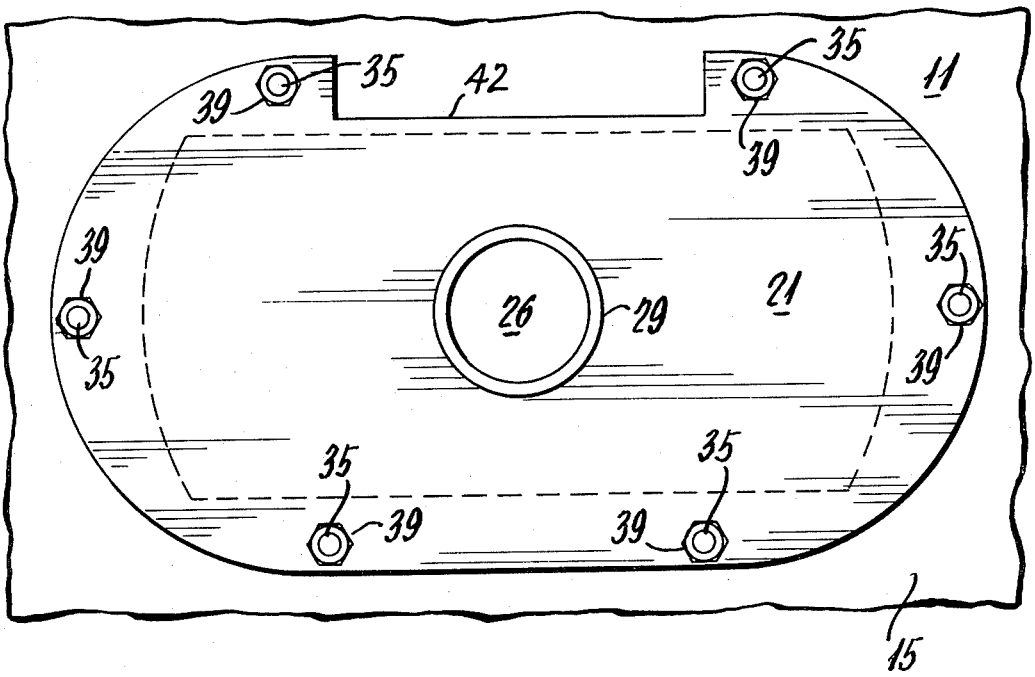
FIG. 2 is a plan view showing the hatch lid structure according to the invention.

It will be observed in FIG. 2 that there may be a cut-out portion 42 along one edge of the plate 21. This is to accommodate the hinge (not shown) that holds the lid (not shown) of the thief hatch, as described above.

While a particular embodiment of the invention has been described herein in accordance with the applicable statutes, this is not to be taken as in any way limiting the invention but merely as being descriptive thereof.

I claim:

1. A removable hatch lid for attaching suction means to degas fumes from a large tank, wherein said tank has at least one hatch with a coaming integral therewith, said coaming having a flange on one edge only for bolting to said tank, said hatch lid comprising impervious planar means for contacting said flangess edge of said coaming to close said hatch, means for fastening said planar means in sealing relation with said flangless edge of said coaming, and gas tight means for coupling said suction means to said planar means for degasing said large tank.

2. A removable hatch lid according to claim 1, wherein said planar means comprises a flat plate extending radially beyond the walls of said coaming.

3. A removable hatch lid according to claim 2, wherein said means for fastening comprises a plurality of bolts near the periphery of said flat plate.

4. A removable hatch lid according to claim 3, wherein said gas tight means comprises a nipple integrally attached to said flat plate over the inside of said coaming.

5. A removable hatch lid according to claim 4, wherein said planar means also comprises gasket means bonded to said flat plate for making a gas tight seal with said flangless edge of said coaming.

6. A removable hatch lid for attaching suction means to degas fumes from the interior of a large tank prior to cleaning said interior, wherein said tank has at least one hatch with a coaming integral therewith and a first plurality of bolts therearound, comprising in combination a flat metallic plate extending radially beyond the walls of said coaming, a resilient material gasket layer bonded to said metallic plate for making a gas tight seal with said coaming, a nipple centrally located and integrally attached to said flat plate for location over the inside of said coaming and adapted for attaching said suction means thereto, and a second plurality of bolts aligned with said first plurality of bolts and a corresponding plurality of socket means all for fastening said plate and gasket layer onto said coaming with a gas tight connection.

* * * * *